US007459854B2

(12) United States Patent
Grundmann et al.

(10) Patent No.: US 7,459,854 B2
(45) Date of Patent: Dec. 2, 2008

(54) HIGH-PRESSURE DISCHARGE LAMP WITH IMPROVED DISCHARGE VESSEL STRUCTURE

(75) Inventors: Dirk Grundmann, Berlin (DE); Conrad Schimke, Berlin (DE)

(73) Assignee: Patent - Treuhand - Gesellschaft für elektrische Glühlampen mbH, Munich (DE)

( * ) Notice: Subject to any disclaimer, the term of this patent is extended or adjusted under 35 U.S.C. 154(b) by 398 days.

(21) Appl. No.: 11/210,874

(22) Filed: Aug. 25, 2005

(65) Prior Publication Data

US 2006/0055330 A1 Mar. 16, 2006

(30) Foreign Application Priority Data

Sep. 10, 2004 (DE) ..... 10 2004 044 366

(51) Int. Cl.
*H01J 17/16* (2006.01)
*H01J 61/30* (2006.01)

(52) U.S. Cl. ..... 313/634; 313/493; 313/567; 313/636; 313/637

(58) Field of Classification Search ..... 313/484, 313/493, 567, 634, 636–638, 643
See application file for complete search history.

(56) References Cited

U.S. PATENT DOCUMENTS 5,144,201 A * 9/1992 Graham et al. ..... 313/634
5,239,230 A * 8/1993 Mathews et al. ..... 313/571
5,497,049 A * 3/1996 Fischer ..... 313/634
6,294,870 B1 * 9/2001 Kawashima et al. ..... 313/623
6,495,962 B2 * 12/2002 Uemura et al. ..... 315/77
6,507,153 B2 * 1/2003 Schoeller et al. ..... 315/56
6,724,145 B1 * 4/2004 Muto et al. ..... 313/638
7,098,596 B2 * 8/2006 Takagaki et al. ..... 313/631

FOREIGN PATENT DOCUMENTS

EP 0 374 676 6/1990
EP 1063681 A2 12/2000
EP 1339090 A1 8/2003
EP 1349197 A2 10/2003
EP 1351276 A2 10/2003

* cited by examiner

*Primary Examiner*—Toan Ton
*Assistant Examiner*—Kevin Quarterman
(74) *Attorney, Agent, or Firm*—William E Meyer

(57) ABSTRACT

A high-pressure discharge lamp for a vehicle headlight having a discharge vessel and electrodes arranged therein for the purpose of generating a gas discharge, the discharge vessel having a central section which is delimited by two planes which are arranged perpendicularly to the connection path of the discharge-side ends of the electrodes and each extend through the discharge-side end of one of the electrodes, wherein the volume, which is arranged in said central section and is filled by the material of the discharge vessel, is greater than or equal to 95 $mm^3$.

4 Claims, 4 Drawing Sheets

HIGH-PRESSURE DISCHARGE LAMP WITH IMPROVED DISCHARGE VESSEL STRUCTURE

I. TECHNICAL FIELD

The invention relates to a high-pressure discharge lamp for a vehicle headlight having a discharge vessel and electrodes arranged therein for the purpose of generating a gas discharge, the discharge vessel having a central section which is delimited by two planes which are arranged perpendicularly to the connection path of the discharge-side ends of the electrodes and each extend through the discharge-side end of one of the electrodes.

II. BACKGROUND ART

Such a high-pressure discharge lamp is disclosed, for example, in the laid-open specification EP 0 374 676 A2. This specification describes a high-pressure discharge lamp for a vehicle headlight having a discharge vessel made from quartz glass and an ionizable filling which comprises metal halides and xenon.

III. DISCLOSURE OF THE INVENTION

It is the object of the invention to provide a generic high-pressure discharge lamp having an extended life.

This object is achieved according to the invention by a high-pressure discharge lamp for a vehicle headlight having a discharge vessel and electrodes arranged therein for the purpose of generating a gas discharge, the discharge vessel having a central section which is delimited by two planes which are arranged perpendicularly to the connection path of the discharge-side ends of the electrodes and each extend through the discharge-side end of one of the electrodes, wherein the volume, which is arranged in said central section and is filled by the material of the discharge vessel, is greater than or equal to 95 $mm^3$. Particularly advantageous embodiments of the invention are described in the dependent patent claims.

The high-pressure discharge lamp according to the invention for vehicle headlights has a discharge vessel having electrodes arranged therein for the purpose of generating a gas discharge, the volume filled by the material of the discharge vessel being greater than or equal to 95 $mm^3$ in the central section of the discharge vessel which is delimited by two planes which are arranged perpendicularly to the connecting path of the discharge-side ends of the electrodes and each extend through the discharge-side end of one of the electrodes.

Figure 4:
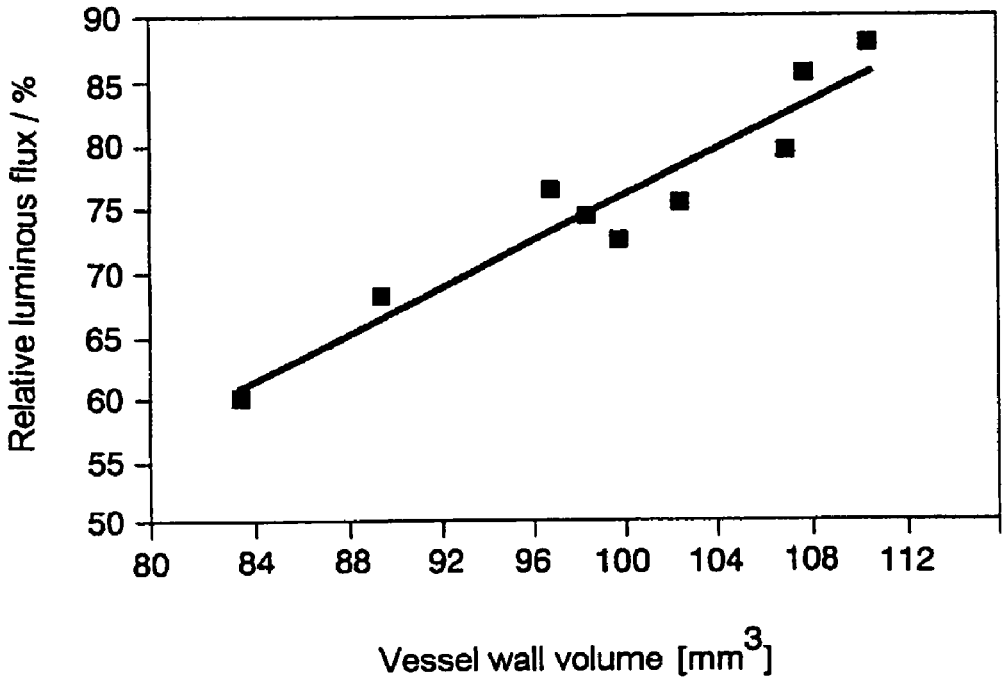

In the case of high-pressure discharge lamps for vehicle headlights which generally have a power rating of less than 50 watts, the volume of the discharge vessel interior is typically less than or equal to 30 $mm^3$. The volume which is filled by the discharge vessel material in the above-defined central section is therefore more than three times as large as the interior of the discharge vessel in the lamps according to the invention. FIG. 4 illustrates the relative luminous flux for a plurality of high-pressure discharge lamps having different volumes, which are filled by the discharge vessel material, in the above-defined central section. In FIG. 4, the volume filled by the discharge vessel material in the central section or the vessel wall volume of the central section of the discharge vessel is plotted on the horizontal axis in the unit $mm^3$, while the relative luminous flux is plotted as a percentage on the vertical axis. In order to determine the relative luminous flux, the luminous flux of the respective high-pressure discharge lamp was measured after 12.5 operating hours and after ageing of the high-pressure discharge lamps in accordance with ECE Rule 99 after 1000 operating hours. After 1000 operating hours, the luminous flux of the high-pressure discharge lamps is now only a certain percentage of its initial luminous flux measured after 12.5 operating hours. It can be seen in FIG. 4 that high-pressure discharge lamps having a larger volume filled by the discharge vessel material and under otherwise identical conditions still have a higher relative luminous flux in the above-defined central section after 1000 operating hours. The high-pressure discharge lamps according to the invention still have at least 70 percent of their initial luminous flux after 1000 operating hours. The residual luminous flux which still remains after 1000 operating hours of the high-pressure discharge lamps is used as the criterion for judging the life expectancy of the high-pressure discharge lamps. High-pressure discharge lamps having a residual luminous flux below 70 percent of their initial luminous flux have a life expectancy which is too low.

Figure 5:
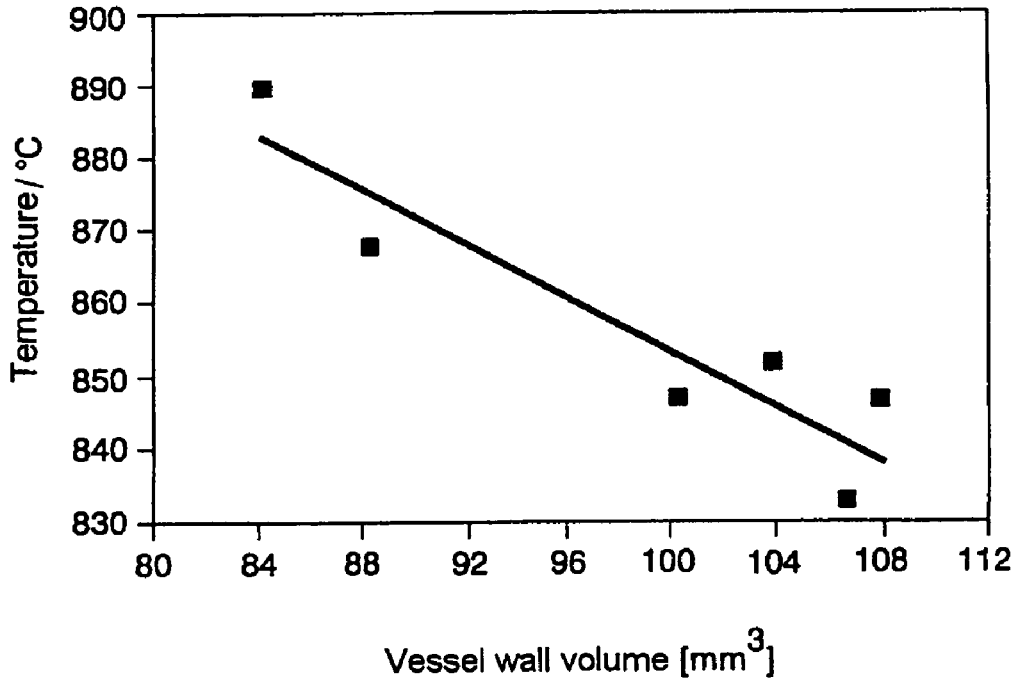

FIG. 5 shows the temperature at the hottest point on the discharge vessel, i.e. on the top of the discharge vessel, to be precise centrally between the electrodes, as a function of the volume, which is arranged in the central section of the discharge vessel and is filled by the discharge vessel material, for a plurality of mercury-free halogen metal-vapor high-pressure discharge lamps during lamp operation. With the lamps according to the invention, the temperature is a maximum of 855 degrees Celsius.

FIG. 5 shows the fact that the high-pressure discharge lamps having a larger volume filled by the discharge vessel material in the above-defined central section and under otherwise identical conditions have a lower temperature on the top of the discharge vessel. Owing to the horizontal lamp operation, i.e. with electrodes arranged on the horizontal plane, the hottest point on the discharge vessel is on its top side. The illustrations in FIGS. 4 and 5 ensure a longer life for the high-pressure discharge lamps according to the invention owing to the comparatively high relative luminous flux and the reduced thermal load on the discharge vessel.

The invention is particularly advantageous for mercury-free halogen metal-vapor high-pressure discharge lamps, i.e. for high-pressure discharge lamps whose ionizable filling is made from metal halides and xenon and contains no mercury, since, with this type of lamp, the decrease in the relative luminous flux over the operating time is particularly severe.

Figure 6:
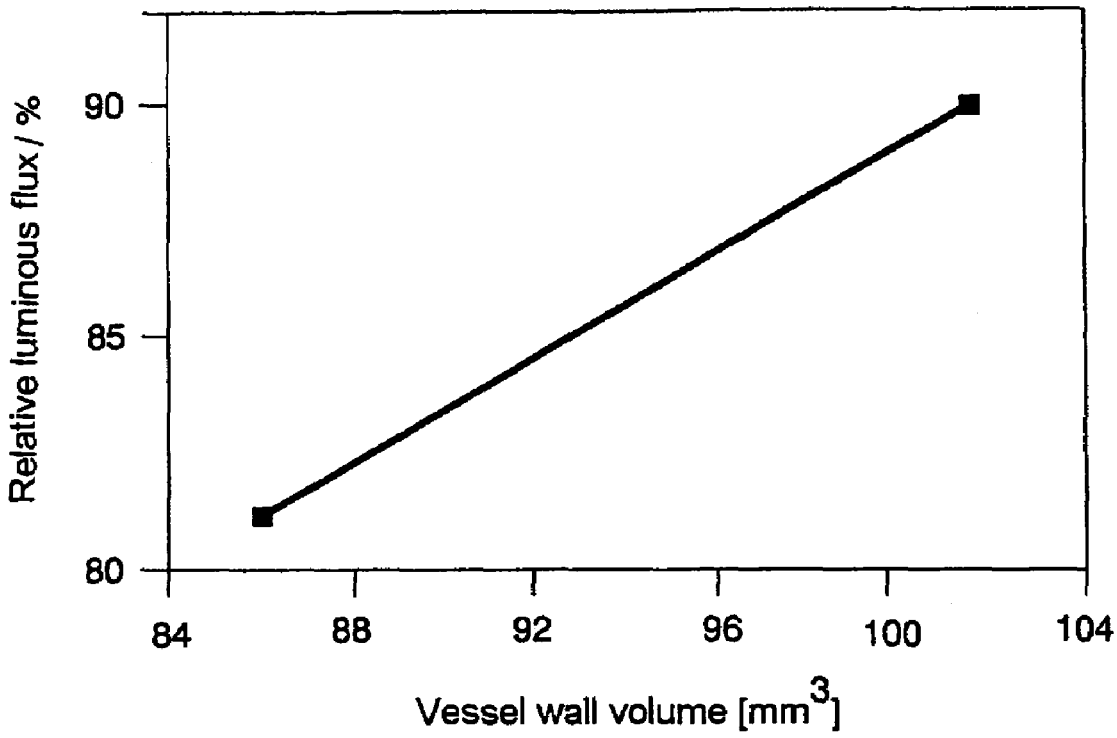

However, the invention may also advantageously be used for the conventional mercury-containing halogen metal-vapor high-pressure discharge lamps, as is illustrated in FIG. 6. FIG. 6 illustrates the relative luminous flux after 1000 operating hours over the volume, which is arranged in the central section of the discharge vessel and is filled by the discharge vessel material, for two mercury-containing halogen metal-vapor high-pressure discharge lamps. The mercury-containing halogen metal-vapor high-pressure discharge lamp according to the invention still has 90 percent of its initial luminous flux after 1000 operating hours.

The discharge vessel of the high-pressure discharge lamps according to the invention is preferably made from quartz glass, i.e. the content by weight of silicon dioxide in the material of the discharge vessel is at least 99 percent by weight. Quartz glass withstands the high operating temperature, the high-pressure and the chemical attack of the ionizable filling. Quartz glass has the advantage over a light-transmissive ceramic, which also offers the abovementioned advantages, that in the case of discharge vessels made from quartz glass it is easier to seal the current feedthroughs.

IV. BRIEF DESCRIPTION OF THE DRAWINGS

Figure 1:
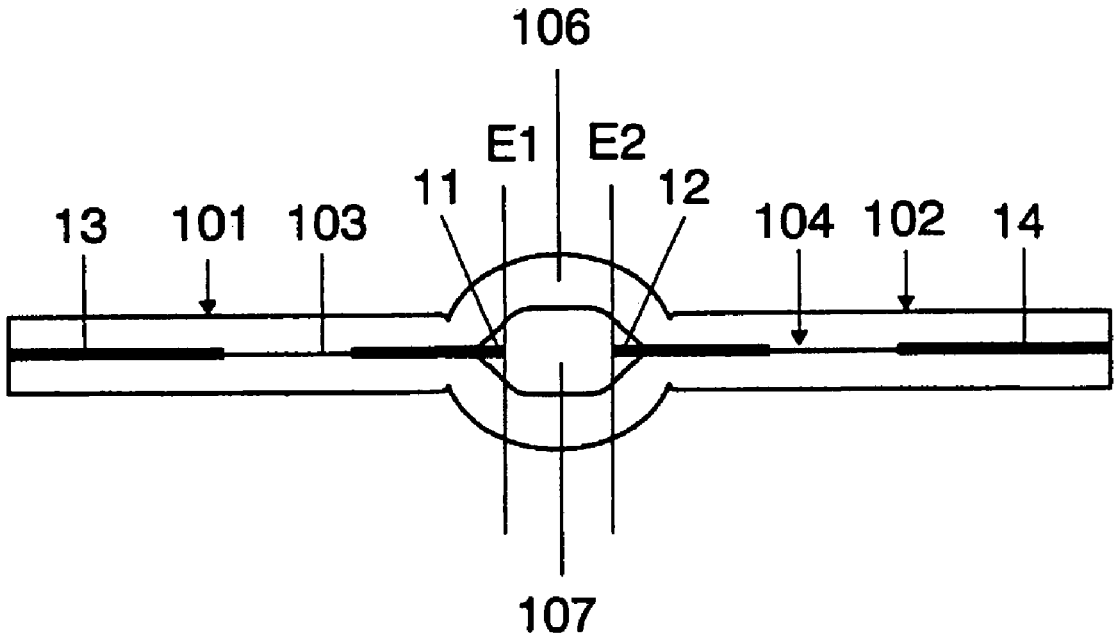
Figure 2:
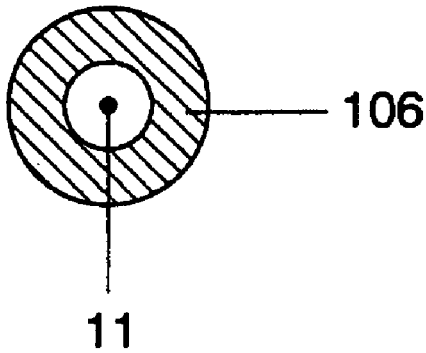
Figure 3:
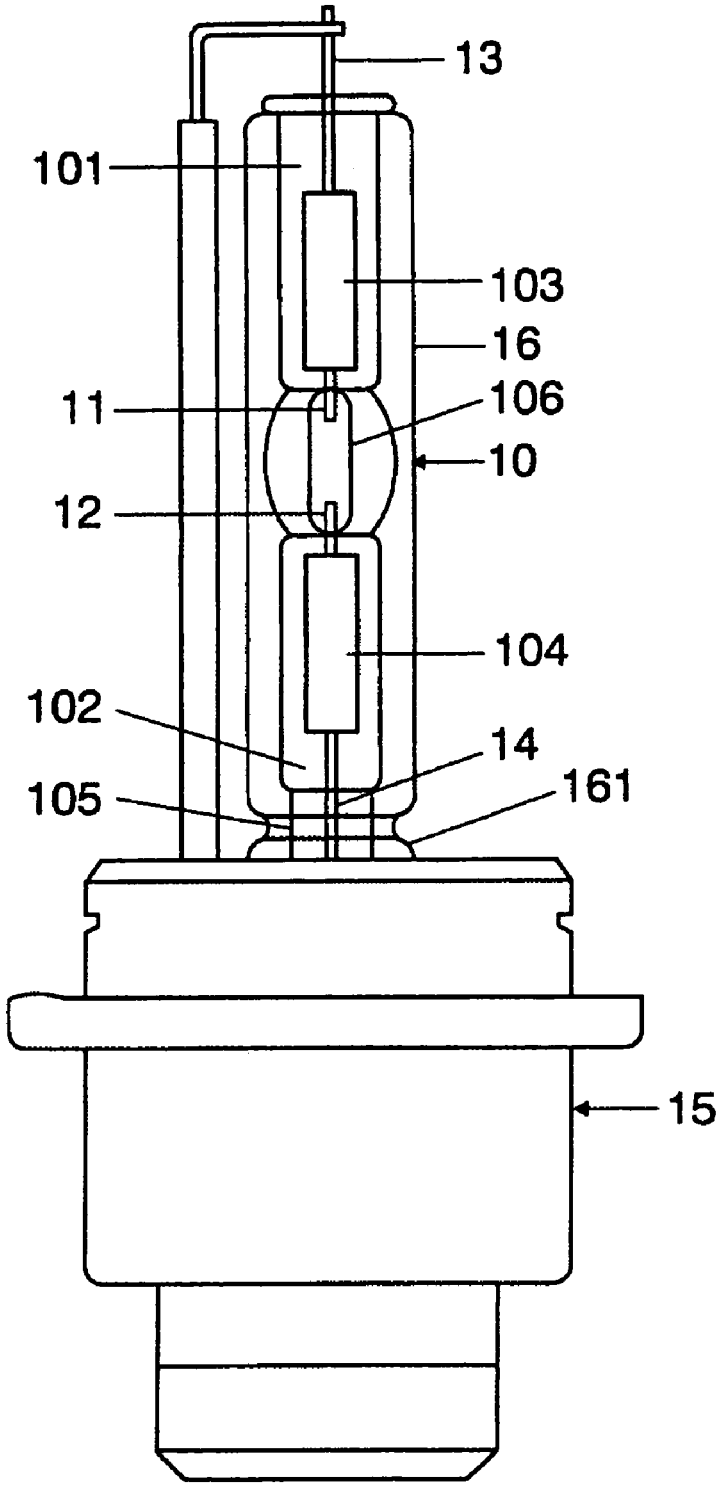

The invention will be explained in more detail below with reference to a preferred exemplary embodiment. In the drawings:

FIG. 1 shows a side view of the discharge vessel of the high-pressure discharge lamp in accordance with the preferred exemplary embodiment, FIG. 2 shows a cross section through the discharge vessel depicted in FIG. 1 in the central section between the electrodes, FIG. 3 shows a side view of the high-pressure discharge lamp in accordance with the preferred exemplary embodiment, FIG. 4 shows the dependence of the relative luminous flux on the volume, which is arranged in the central section of the discharge vessel and is filled by the material of the discharge vessel, for a plurality of mercury-free halogen metal-vapor high-pressure discharge lamps, FIG. 5 shows the temperature of the top of the discharge vessel as a function of the volume, which is arranged in the central section of the discharge vessel and is filled by the material of the discharge vessel, for a plurality of mercury-free halogen metal-vapor high-pressure discharge lamps, and FIG. 6 shows the dependence of the relative luminous flux on the volume, which is arranged in the central section of the discharge vessel and is filled by the material of the discharge vessel, for two mercury-containing halogen metal-vapor high-pressure discharge lamps.

V. BEST MODE FOR CARRYING OUT THE INVENTION

FIG. 3 is a schematic illustration of a high-pressure discharge lamp in accordance with the preferred exemplary embodiment of the invention. Of concern here is a halogen metal-vapor high-pressure discharge lamp having a power rating of 35 watts. This lamp is envisaged for use in a vehicle headlight. It has a discharge vessel 10 which is sealed at two ends and is made from quartz glass, whose interior 107 has a volume of 22.5 $mm^3$, and in which an ionizable filling is enclosed in a gas-tight manner. In the central section 106 of the discharge vessel 10, the inner contour of the discharge vessel 10 is circular-cylindrical and its outer contour corresponds essentially to that of a circular barrel body, i.e. the outer contour is produced by rotation of a circular arc around the discharge vessel axis. The inner diameter of the central section 106 is 2.6 mm, and its largest outer diameter is 6.3 mm. The two ends 101, 102 of the discharge vessel 10 are each sealed by means of a fused molybdenum foil seal 103, 104. Located in the interior 107 of the discharge vessel 10 are two electrodes 11, 12, between which the discharge arc responsible for light emission is formed during lamp operation. The electrodes 11, 12 are made from tungsten and extend on the discharge vessel axis. Their thickness or their diameter is 0.30 mm. The distance between the electrodes 11, 12 is 4.2 mm. The electrodes 11, 12 are each electrically conductively connected to an electrical connection of the essentially plastic lamp base 15 via one of the fused molybdenum foil seals 103, 104 and via the power supply line 13 remote from the base or via the base-side power return line 14. The discharge vessel 10 is surrounded by a vitreous outer bulb 16. The outer bulb 16 has a protrusion 161 anchored in the base 15. The discharge vessel 10 has a tubular extension 105 made from quartz glass on the base side, the base-side power supply line 14 extending in said tubular extension 105. A starting device having a starting transformer may be arranged in the interior of the base 15.

FIG. 3 is a schematic depiction of the discharge vessel 10 of this high-pressure discharge lamp. The central section 106 of the discharge vessel 10 is delimited by two planes E1, E2 which are both arranged perpendicularly to the discharge vessel axis. The plane E1 extends through the discharge-side end of the electrode 11, and the plane E2 extends through the discharge-side end of the electrode 12. The planes E1, E2 are therefore arranged at the same distance from one another as the two electrodes 11, 12. The central section 106 of the discharge vessel 10 is arranged between the two planes E1, E2. The volume filled by the quartz glass of the vessel wall of the central section 106 is 99.1 $mm^3$. In the center of the central section 106, the cross-sectional area of the discharge vessel wall which is oriented perpendicularly with respect to the discharge vessel axis is 25.9 $mm^2$. At the two edges of the central section 106, the cross-sectional area of the discharge vessel wall which is oriented perpendicularly with respect to the discharge vessel axis is 19.0 $mm^2$. The largest value for the wall thickness of the central section 106, which is assumed to be in the center, is 1.85 mm, and the smallest value, which is assumed to be at the two edges at the planes E1, E2, is 1.48 mm.

The ionizable filling of the high-pressure discharge lamps according to the invention contains xenon, the halides, for example iodides, of the metals sodium and scandium and possibly the halides of further metals, such as zinc and indium. The ionizable filling of the mercury-containing high-pressure discharge lamps according to the invention also contain mercury in addition to the abovementioned components.

The invention is not restricted to the exemplary embodiments described in more detail above. In particular, the geometry of the discharge vessel may differ from the geometry depicted in FIG. 1 or 3. The geometry of the discharge vessel may be selected as desired. For example, the outer contour of the discharge vessel may be spherical, ellipsoidal or cylindrical. The inner contour of the discharge vessel may have the same geometry as the outer contour, i.e. likewise be spherical, ellipsoidal or cylindrical, or else have another geometry, for example a circular-cylindrical geometry.

What is claimed is:

1. A high-pressure discharge lamp for a vehicle headlight having a discharge vessel and electrodes arranged therein for the purpose of generating a gas discharge, the discharge vessel having a wall defining an interior volume, the wall having a central section which is delimited by two planes which are arranged perpendicularly to the connection path of the discharge-side ends of the electrodes and each extend through the discharge-side end of one of the electrodes, wherein the volume of said central wall section, which is arranged in said central section and is filled by the material of the discharge vessel, is greater than or equal to 95 $mm^3$, and the interior of the discharge vessel has an interior volume of less than or equal to 30 $mm^3$.

2. The high-pressure discharge lamp as claimed in claim 1, wherein the discharge vessel is made from quartz glass.

3. The high-pressure discharge lamp as claimed in claim 1, wherein an ionizable filling, which comprises metal halides and xenon, is arranged in the interior of the discharge vessel.

4. The high-pressure discharge lamp as claimed in claim 1, wherein the electrodes have tips with a separation distance that is less than or equal to 4.2 millimeters.

* * * * *